United States Patent [19]

Burleigh

[11] 4,197,619

[45] Apr. 15, 1980

[54] TONGUE AND BUCKLE FASTENER FOR A SAFETY BELT HARNESS

[75] Inventor: David W. Burleigh, Bognor Regis, England

[73] Assignee: Britax (Wingard) Limited, England

[21] Appl. No.: 969,049

[22] Filed: Dec. 13, 1978

[30] Foreign Application Priority Data

Sep. 22, 1978 [DE] Fed. Rep. of Germany ... 7828214[U]

[51] Int. Cl.[2] ..... A44B 11/26

[52] U.S. Cl. ..... 24/230 AL

[58] Field of Search ..... 24/230 R, 230 AL, 230 A

[56] References Cited

U.S. PATENT DOCUMENTS

| | | | |
|---|---|---|---|
| 3,170,211 | 2/1965 | Van Noord | 24/230 A |
| 3,349,445 | 10/1967 | Foster | 24/230 A |
| 3,522,640 | 8/1970 | Lohr | 24/230 AL |
| 3,656,211 | 4/1972 | Turner | 24/230 AL |
| 3,763,523 | 10/1973 | Lindblad | 24/230 AL |
| 3,789,492 | 2/1974 | Klink | 24/230 AL |
| 4,096,606 | 6/1978 | Stephenson | 24/230 A |

*Primary Examiner*—Nile C. Byers, Jr.

*Attorney, Agent, or Firm*—Steele, Gould & Fried

[57] ABSTRACT

A tongue and buckle fastener for a safety belt harness in which the tongue has a head portion securable by a spring-loaded latching member in the buckle. A spring loaded tongue ejector ejects the tongue from the buckle after operating a push-button to move the latching member to a release position. The latching member is biased and guided for movement transversely of the tongue insertion direction. A camming member, between the push-button and the latching member, is guided for movement in the tongue insertion direction. The camming member has ramps, one at each side, which co-operate with respective shoulders on the latching member. A pair of spring arms exert a return bias on the camming member and extend between the shoulders and the ramps.

5 Claims, 5 Drawing Figures

TONGUE AND BUCKLE FASTENER FOR A SAFETY BELT HARNESS

Figure 1:
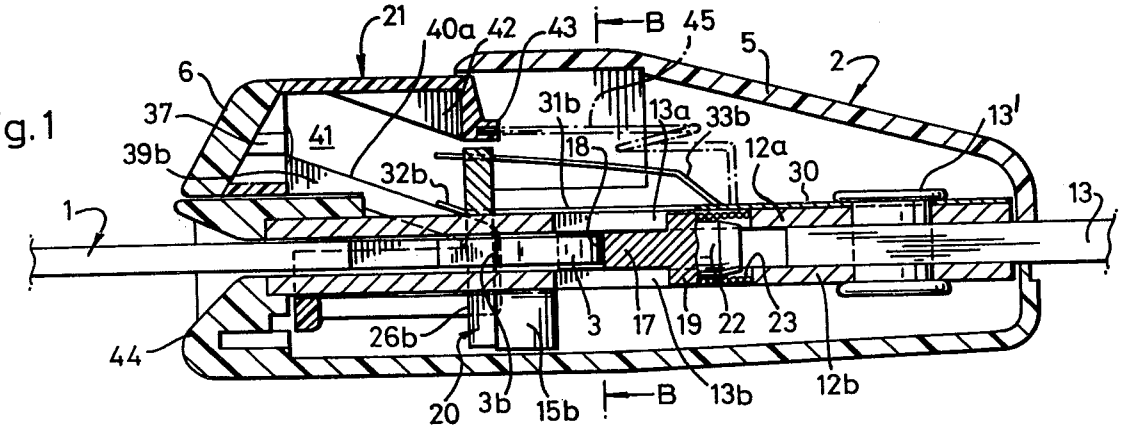

The invention relates to a tongue and buckle fastener for a safety belt harness; the tongue has a head portion which can be secured by a spring-loaded latching member in the buckle, the buckle includes a pair of frame members which are spaced apart to define a passageway for receiving of the tongue, a spring-loaded tongue ejector which is slidable in the passageway, and a spring-loaded push-button which is provided to move the latching member to a released position to enable ejection of the tongue by the ejector.

DOS No. 2,6000,614 describes a tongue and buckle fastener comprising a lever which is accessible through an opening in a housing part of the buckle, a co-operating locking member which is sprung open by the lever when the lever is depressed through the opening in the housing, and a projection attached to the lever and having a bevelled surface, the projection extending away from the locking member towards the entrance of a passageway for the insertion of the tongue. When the tongue is inserted, it meets the bevelled edge of the projection whereby the projection, and hence the lever, are raised to move the locking member out of the path of insertion of the tongue into the passageway. As the tongue is inserted, a spring-loaded ejector is pushed to the rear of the passageway and the lever is raised towards the opening in the housing of the buckle. Eventually, the locking member is sprung back into an opening in the tongue to secure the same against removal. When the lever is depressed, through the opening in the housing, it pivots so as to raise the locking member to release the tongue which is then urged out of the passageway by the ejector. A disadvantage of this arrangement is that the tongue must be inserted against the friction of the bevelled edge of the projection, against the spring biasing of the lever which is exerted on the projection as well as against the return bias of the ejector. The spring acting on the locking member, which is raised by the projection of the lever, must be strong enough to ensure positive latching when the tongue is fully inserted in the buckle. Moreover, wear can take place between the bevelled edge of the projection and the tongue due to repeated use, which wear may affect the release position of the locking member.

U.S. Pat. No. 3,763,523 describes a tongue and buckle fastener of the same type but in which the tongue has an opening with inclined edges which frictionally engage the inclined edges of a spring biased locking member when the tongue is inserted in the buckle. This arrangement therefore suffers from similar disadvantages.

The problem facing the invention is to provide a tongue and buckle fastener in which sufficient spring bias can be exerted to ensure positive latching, but where the forces acting against the tongue, on insertion, are relieved. There is also the problem of avoiding frictional wear on co-operating surfaces, which may affect the release position of the locking member.

The invention solves these problems by providing a latching member which is biased and guided for movement between its latching and release position transversely of the direction of insertion of the tongue in the passageway defined by the frame members. As the bias on the latching member is transverse to the direction of insertion of the tongue in the passageway, this bias does not counteract tongue insertion. The spring which biases the latching member into its latching position can therefore act to ensure positive latching without directly counteracting insertion of the tongue. Some frictional engagement will occur between the tongue and the latching member as the tongue is inserted. However, this friction does not lead to any possibility that the latching member will not be sufficiently displaced to provide access for the tongue, when inserted. A camming member is also provided, between the push-button and the latching member, and is guided for movement in the direction of insertion of the tongue into the passageway. The camming member has a ramp at each side to co-operate with respective shoulders on the latching member. A pair of spring arms exert a return bias on the ramps when the push-button is depressed. Each spring arm extends between the respective shoulder on the latching member and the respective ramp on the camming member thereby avoiding frictional engagement between the latching and camming members when the push-button is depressed. When the push-button is depressed, the ramps slide under the spring arms and thereby cam them upwardly so as to raise latching member into its released position. When the tongue has been removed from the buckle, the latching member is maintained in its released position by the ejector which slides beneath the latching member. When the tongue is inserted into the buckle, the latching member is maintained in its released position by the head portion of the tongue as it slides beneath the latching member. However, when the tongue has been fully inserted, the latching member slides off the sides of the head portion of the tongue and is biased into its latching position to secure the tongue against removal from the buckle.

Preferably the spring arms are the arms of a main spring member having at least one leaf or arm which acts to bias the latching member into its latching position.

Figure 2:
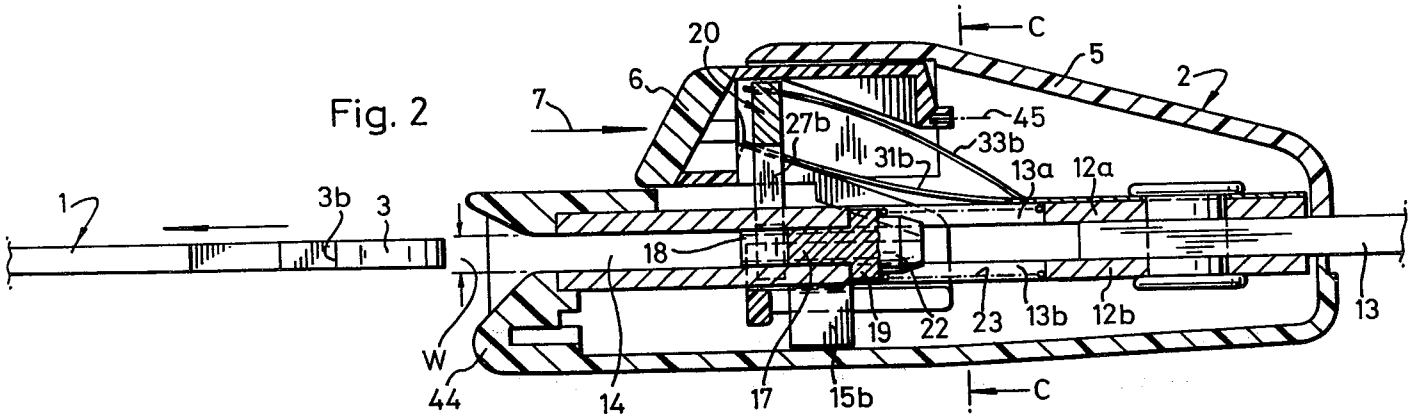
Figure 3:
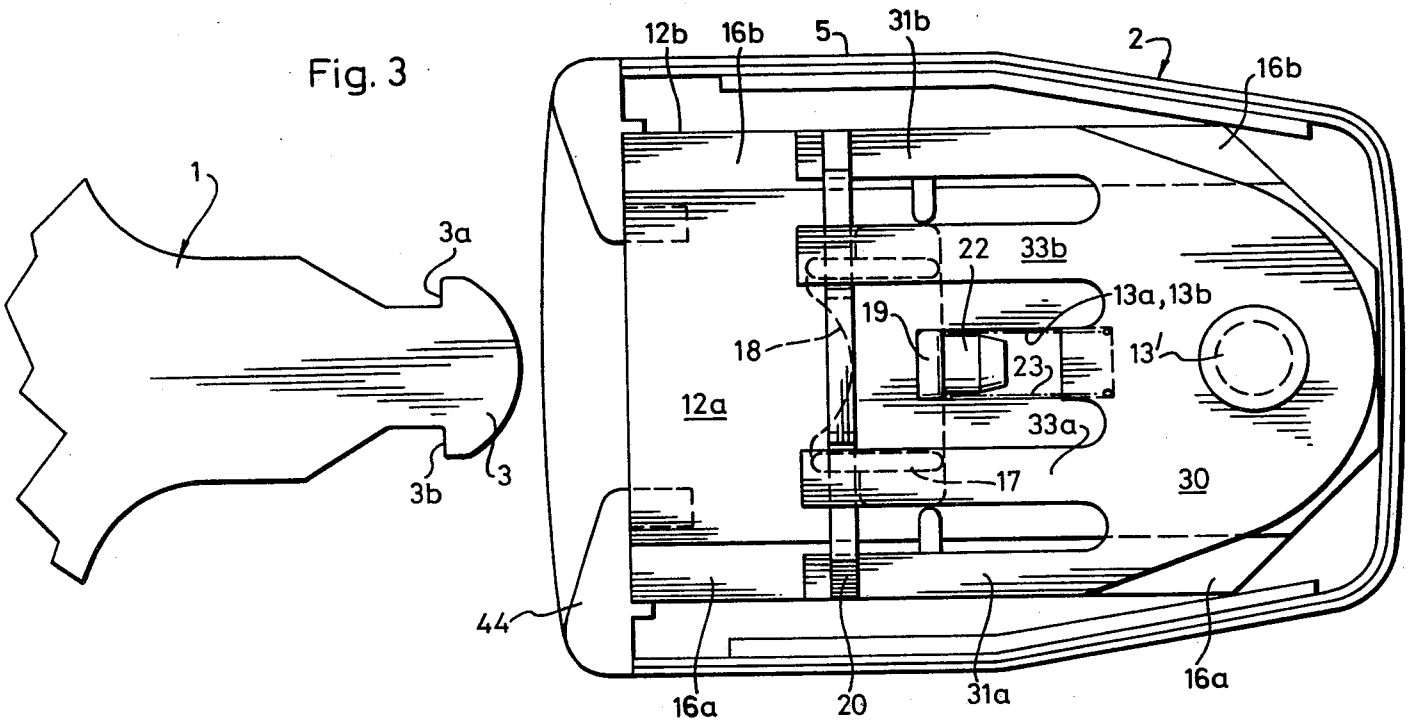
Figure 4:
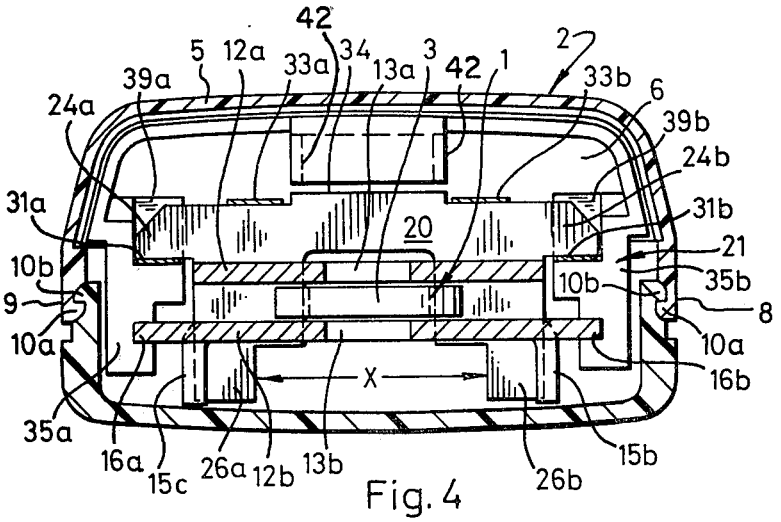
Figure 5:
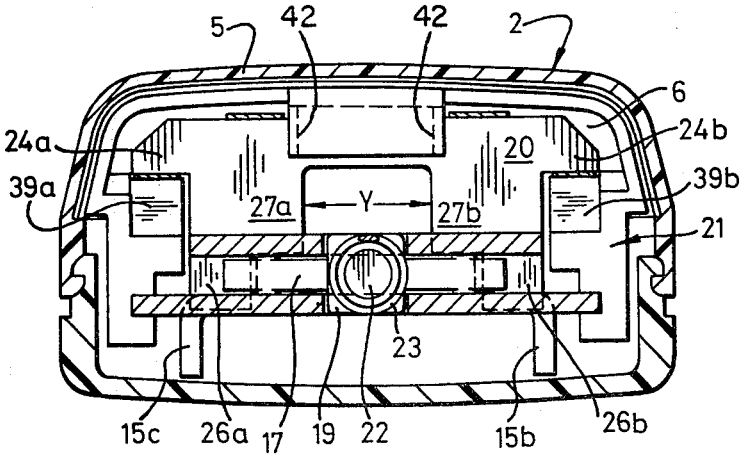

One way of carrying out the invention is described in detail below with reference to drawings which illustrate only one specific embodiment, in which:

FIGS. 1 and 2 are sectional elevations of a buckle with the tongue inserted and ejected respectively, FIG. 3 is a plan view, of the mechanism of FIG. 1 with the upper casing removed and with the tongue ejected, FIGS. 4 and 5 are transverse sections on lines BB,CC respectively of the buckle shown in FIGS. 1 and 2.

The Figures show a tongue 1 and a buckle 2. The tongue 1 has a head portion 3 with a pair of latching shoulders 3*a* and 3*b*. The head portion 3 is radiused to provide a nose for engaging a similarly radiused recess in an ejector member described below.

The buckle 2 comprises a housing 5 in which a push-button 6 is slidably mounted for movement in the direction of the arrow 7. As seen in FIG. 4, the housing 5 is of a two part construction which is secured along both sides by interengaging hooked portions 10*a*, 10*b*. The housing 5 contains a pair of frame members 12*a*, 12*b* which are secured together with an intermediate mounting bracket portion 13 by a rivet 13'. The frame members 12*a*, 12*b* are in the form of plates with cutouts 13*a*, 13*b*. The distance W between the plates 12*a*, 12*b* is slightly greater than the thickness of the tongue 1. The plates 12*a*, 12*b* therefore form a passageway 14 into which the tongue can be inserted. As seen in the drawing, the lower plate 12*b* has turned down portions 15*b*, 15*c* which serve to protect the lower end of the latching member 20 from any crushing loads which may be applied to the buckle in service. Plate 12*b* also has laterally extending portions 16*a*, 16*b* which serve as guides for a camming member 21.

An ejector 17, has a radiused recess 18 for engaging the radiused edge of the head portion 3 of the tongue 1. The rear portion of the ejector 17 is formed by a rectangular section portion 19, which projects into the respective cutouts 13*a* and 13*b* of plates 12*a*, 12*b*. This serves to guide the ejector 17 longitudinally of the passageway 14 when the tongue is inserted. A circular section portion 22 with a chamfered edge serves to locate one end of a coil spring 23, the other end of which engages the ends of the cut-outs 13*a* and 13*b*.

A latching member 20 is in the form of a bridge having a pair of oppositely directed lateral shoulders 24*a*, 25*b*. The bridge 20 is also provided with a pair of downwardly directed feet 26*a*, 26*b*, the distance X therebetween being slightly larger than the breadth of the head portion 3 of the tongue 1. A pair of inwardly directed shoulders 27*a*, 27*b* adjoin the respective feed 26*a*, 26*b*. The distance Y between the shoulders 27*a*, 27*b* enables the radiused end of the head portion 3 of the tongue 1 to engage with the radiused recess 18 of the ejector 17. However, when the bridge 20 is in its latching position, the shoulders 27*a*, 27*b* serve to engage the respective latching shoulders 37*a*, 37*b* of the tongue 1 when fully inserted into the buckle.

A spring member 30 is in the form of a flat plate with an aperture to receive the rivet 13' which secures it to the upper frame member 12*a*. It also has a pair of outer arms 31*a*, 31*b*, which are positioned so as to extend beneath the shoulders 24*a*, 24*b* of the bridge 20 and to terminate in turned-up ends, only one of which, namely 32*b*, is seen in FIG. 1. A pair of inner arms 33*a*, 33*b*, which serve as leaf springs, rest on the top of the bridge 20, one on each side of a protuberance 34. The springs 33*a*, 33*b* provide a downward bias on the bridge 20 which acts substantially perpendicularly of the direction of insertion of the tongue 1 into the buckle.

A camming member 21 is secured by a rivet 37 to the push-button 6. The camming member extends over the upper plate 12*a*, adjacent the roof of housing 5 and downwardly, at each side, as shown in FIG. 4. The sides 35*a*, 35*b* are provided with grooves which are slidably located on the guides provided by the laterally extending portions 16*a*, 16*b* respectively of the lower plate 12*b*. This enables the push-button 6 and camming member 21 to be slidably guided in the direction of insertion of the tongue 1. The camming member 21 has a pair of ramps 39*a*, 39*b* which form camming surfaces (see 40*a* of FIG. 1). On depressing the push-button 6, the camming member 21 moves towards the bridge 20 and the camming surfaces 40*a* raise the bridge 20 into a recess 41. This movement also loads the inner leaf springs 33*a*, 33*b* which bear down on the bridge 20. The recess 41 appears to be inclined in FIG. 1 due to the position of the pair of triangular strengthening webs 42 and the ramped surfaces 40*a*. It will also be noted from FIGS. 1–4, that the ends of the arms 31*a*, 31*b* pass beneath the shoulders 24*a*, 24*b* of the bridge 20 and rest on the camming surfaces 40*a*, 40*b*. This avoids friction between the camming member 21 and the bridge 20 which would otherwise lead to wear of the camming surfaces (e.g. camming member is made of plastics and latching member is made of steel.

A return spring 45 is located in the housing so as to engage part 43 of the camming member 21 and to serve as a return spring for the push-button and member 21.

The entrance of passageway 14 is bounded by a mouthpiece 44 which also serves to locate the ends of plates 12*a*, 12*b*. At the other end of the buckle, the housing 5 is apertured so as to receive the mounting bracket portion 13.

In operation, the tongue 1 is inserted into the passageway 14 with the buckle 2 in the state shown in FIG. 2 (FIG. 2 also illustrates the ejection of tongue 1 by depressing the push-button 6 in the direction of the arrow). The latching bridge 20 is in a raised position because the shoulders 27*a*, 27*b* rest on the upper, forwardly extending surfaces of the ejector 17. When the head portion 3 of the tongue 1 engages the recessed portion 18 of the ejector 17, the ejector begins to move rearwardly against the bias of spring 23. On continued insertion, the head portion of the tongue passes beneath the lower edges of shoulders 27*a*, 27*b* and the bridge 20 is thereby maintained in its raised or released position. Eventually, the latching shoulders 3*a*, 3*b* of the tongue 1 pass beneath the shoulders 27*a*, 27*b* and the bridge 20 is urged downwardly, by the leaf springs 33*a*, 33*b* into its latching position as shown in FIG. 1. The return spring 45 urges the camming member 21 into a position such that the part 43 thereof is aligned with the bridge 20, thereby preventing the bridge 20 from being shaken out of its engaged position by a lateral impact on the buckle. Spring 23 has been compressed and is ready to eject the tongue when bridge 20 is next raised.

As shown in FIG. 2, the push-button 6 has been depressed to move the camming member 21 rearwardly. This has resulted in the movement of bridge 20 into its raised position due to the ramps 39*a*, 39*b* sliding under the spring arms 31*a*,31*b* and beneath the shoulders 24*a*, 24*b* of the bridge 20. The spring arms 31*a*, 31*b* and 33*a*, 33*b* have been deflected and tensioned as shown in FIG. 2. As soon as the latching shoulders 27*a*, 27*b* are clear of the edges of the latching shoulders 3*a*, 3*b* of the tongue 1, the tongue is ejected by the spring 23. As the tongue slides beneath the shoulders 27*a*, 27*b*, the ejector 17 follows in order to maintain the bridge 20 in its raised position, in preparation for the next insertion of the tongue.

The invention has been disclosed in terms of a preferred embodiment but modifications may be made, as apparent to those skilled in the art, without departing from the scope of the invention as described in the following claims.

What is claimed is:

1. An improvement in a tongue and buckle fastener for a safety belt harness, said fastener including a tongue having a head portion; a buckle; said buckle including a spring-loaded latching member for securing said head portion of said tongue, a pair of frame members which are spaced apart to define a passageway for receiving said tongue, a spring-loaded tongue ejector which is slidable in said passageway and a spring-loaded push-button which is provided to move said latching member to a release position to enable ejection of said tongue by said ejector; the improvement comprising:

means for guiding said latching member, for movement between its latching and release positions, transversely of the direction of insertion of said tongue in said passageway; a camming member which is provided between said push-button and said latching member; means for guiding said camming member for movement in said direction of tongue insertion, said camming member having ramps, one at each side, to co-operate with respective shoulders on said latching member; and a pair of spring arms which exert a return bias on said camming member and which respectively extend between said shoulders and said ramps.

2. The improvement according to claim 1 wherein said spring arms are part of a main spring member, said main spring member having at least one further arm which acts to bias said latching member into its latching position.

3. The improvement according to claim 1 wherein said head portion of said tongue includes a pair of outwardly directed shoulders; said latching member is in the form of a bridge having a pair of downwardly directed feet, the distance between said feet slightly exceeding the breadth of said head portion of said tongue; said bridge also having a pair of inwardly directed shoulders, the distance between said inwardly directed shoulders being less than the breadth of said head portion of said tongue; said ejector being forwardly biased by a spring to slide beneath said inwardly directed shoulders when said tongue is removed from said buckle.

4. A tongue and buckle fastener for a safety belt harness, said fastener comprising:

a tongue, said tongue having a head portion;

a buckle;

a latching member in said buckle, said latching member being in the form of a bridge having a pair of downwardly directed feet, the distance between said feet slightly exceeding the breadth of said head portion of said tongue, said bridge also having a pair of inwardly directed shoulders for securing said head portion of said tongue, the distance between said inwardly directed shoulders being less than the breadth of said head portion of said tongue, and said bridge having a pair of outwardly directed shoulders;

a pair of frame members in said buckle, said frame members being spaced apart to define a passageway for receiving said tongue;

a tongue ejector in said buckle, said ejector being slidable in said passageway;

a spring for biasing said ejector whereby said ejector slides beneath said inwardly directed shoulders when said tongue is removed from said buckle;

a spring loaded push-button in said buckle, said push-button moving said latching member to a release position to enable ejection of said tongue by said ejector;

means in said buckle for guiding said latching member, for movement between its latching and release positions, transversely of the direction of insertion of said tongue in said passageway;

a camming member in said buckle, said camming member having ramps, one at each side, to co-operate with said outwardly directed shoulders of said latching member;

means for guiding said camming member for movement in said direction of tongue insertion; and a main spring member, said main spring member having a pair of spring arms which exert a return bias on said camming member and which respectively extend between said outwardly directed shoulders and said ramps, and said main spring member having at least one further arm which acts to bias said latching member into its latching position.

5. A tongue and buckle fastener for a safety belt harness, comprising a tongue and buckle, the buckle comprising means defining a passageway for receiving the tongue, a latching member moveable transversely of the passageway between a latching position in which it retains the tongue in the passageway and a release position in which the tongue is removeable therefrom, spring means for biasing the latching member into the latched position, a spring-loaded push-button displaceable longitudinally of the passageway and operative when depressed to move the latching member to the release position, and blocking means fast with the push-button and operative when the tongue is secured in the passageway to block movement of the latching member to the release position prior to the depression of the push-button.

* * * * *